United States Patent [19]

Chen

[11] Patent Number: 4,917,377

[45] Date of Patent: Apr. 17, 1990

[54] EXERCISE BICYCLE

[76] Inventor: Chih S. Chen, No. 30, Lane 229, Pu Tsai Keng Rd., Tai Ping Hsiang, Taichung Hsien, Taiwan

[21] Appl. No.: 372,549

[22] Filed: Jun. 28, 1989

[51] Int. Cl.[4] ..... A63B 23/04

[52] U.S. Cl. ..... 272/73; 272/DIG. 4

[58] Field of Search ..... 272/73, 72, 130, 132, 272/DIG. 45, 131, 128

[56] References Cited

U.S. PATENT DOCUMENTS

| | | | |
|---|---|---|---|
| 3,100,640 | 8/1963 | Weitzel | 272/73 |
| 3,995,491 | 12/1976 | Wolfla | 272/73 |
| 4,705,269 | 11/1987 | De Boer et al. | 272/73 |

FOREIGN PATENT DOCUMENTS

| | | | |
|---|---|---|---|
| 80/01452 | 7/1980 | PCT Int'l Appl. | 272/73 |

OTHER PUBLICATIONS

Snellen—Technical Note—Medical & Biological Engineering & Computing—May 1981, pp. 356–358.

*Primary Examiner*—Stephen R. Crow

*Attorney, Agent, or Firm*—Morton J. Rosenberg; David I. Klein

[57] ABSTRACT

An exercise bicycle includes a frame body with a seat and a pair of handles. A chain transmission is provided on a lower part of the frame body. The chain transmission includes two chain wheels and a chain. A pair of foot pedals are pivoted on a rear chain wheel. A pair of discs are attached to a front chain wheel and driven by the pedals via the chain transmission. A pair of casings are fixed on both sides of the lower part of the frame body for encompassing the chain transmission. A brake unit is fixed relative to the frame body at a position located between the discs and is actuated by a controller via a cable so as to brake the discs. The frame body has a base with two pairs of extendible shafts for providing a larger base area for the exercise bicycle.

2 Claims, 4 Drawing Sheets

EXERCISE BICYCLE

FIELD OF THE INVENTION

The present invention relates to an exercising mechanism, and more particularly to an exercise bicycle.

BACKGROUND OF THE INVENTION

People living in today's busy world have no time to do outdoor exercises. Therefore, indoor exercising mechanisms, e.g., exercise bicycles have become more and more popular and are widely used.

Generally, a conventional exercise bicycle comprises a frame with a pair of handles and a seat. A spoked wheel which is very similar to that used on a conventional bicycle is rotatably provided on the frame and is driven by a pair of pedals. The spoked wheel rotates freely and gives people a feeling as if on a bicycle. This feeling often quenches exercise desires.

SUMMARY OF THE INVENTION

The primary object of the present invention is to provide an exercise bicycle which has a diverse and compact structure.

The present invention seeks to provide an exercise bicycle including a frame body with a seat and a pair of handles. A pair of discs are provided at a front end of the frame body and are actuated by a pair of pedals. Discs with various weights and with various ornamental patterns on an outer surface thereof are provided and are interchangeable.

Further objects and advantages of the present invention will become apparent from a careful reading of the detailed description provided hereinbelow, with appropriate reference to the accompanying drawings.

DETAILED DESCRIPTION OF THE INVENTION

Figure 1:
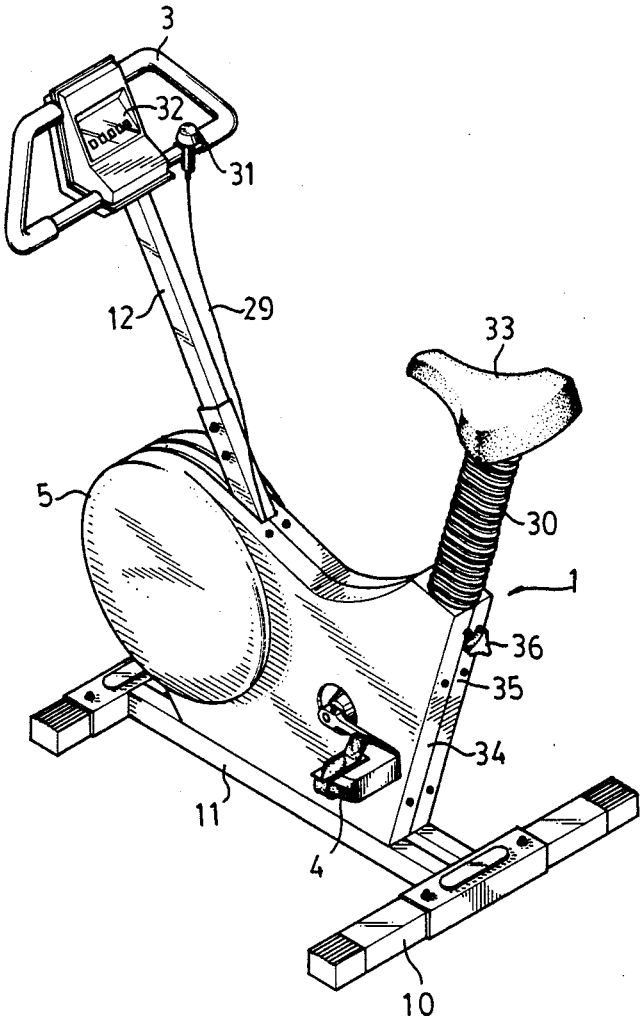
FIG. 1 is a perspective view of an exercise bicycle in accordance with the present invention.

Referring to the drawings and initially to FIG. 1, the exercise bicycle in accordance with the present invention comprises generally a frame body 1 with a pair of handles 3 and a seat 33. The handles 3 and a display 32, for such as a speedometer, are fixed on an upper end of a bised frame bar 12. A base 11 is generally an I-shaped frame with two pairs of extendible shafts 10 for providing a larger base area. Therefore, a stable construction of the exercise bicycle is obtained. A pair of discs 5 are rotatably actuated by a pair of pedals 4. A pair of casings 34, 35 enclose a lower part of the frame body 1. A height of the seat 33 is adjustable by an adjusting screw 36 via an extension rod 30. A brake controller 31 with a cable 29 is fixed on a handle 3.

Figure 2:
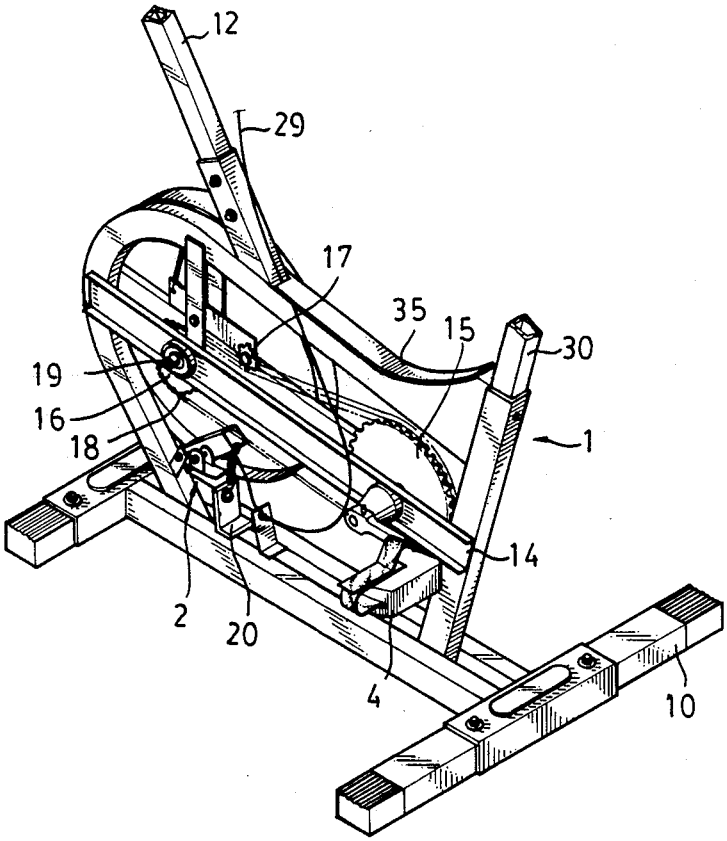
FIG. 2 is a partial perspective view showing the inner construction of the exercise bicycle of FIG. 1.

Referring next to FIG. 2, a chain transmission, including two chain wheels 15, 16 and a chain 18, is supported with the two axles of the chain wheels 15, 16 on two parallel supporting beams 14. The pedals 4 are fixed on the axle of a rear chain wheel 15 such that the rear chain wheel 15 is drivable by the pedals 4. A pinion 17 is provided for pressing the chain 18 and serves as a tension pulley. Two discs 5 (FIG. 1) are attachable to an axle 19 of a front chain wheel 16 by such as threaded engagement or press-fitted engagement which can be easily achieved by present techniques. A number of pairs of discs 5, are provided each pair being of similar shape and having a different weight and different decorative pattern provided on an outer surface thereof, to be interchangeably attached to the axle 19 of the front chain wheel 16 for accomodating various preferences of the people using the exercise bicycle. A rim 50 (FIG. 4) extending in a plane substantially vertical to the plane of the disc 5 is formed on the peripheral surface of each disc 5. A brake unit 2, which will be described with further details below, is fixed on the frame body 1.

Figure 3:
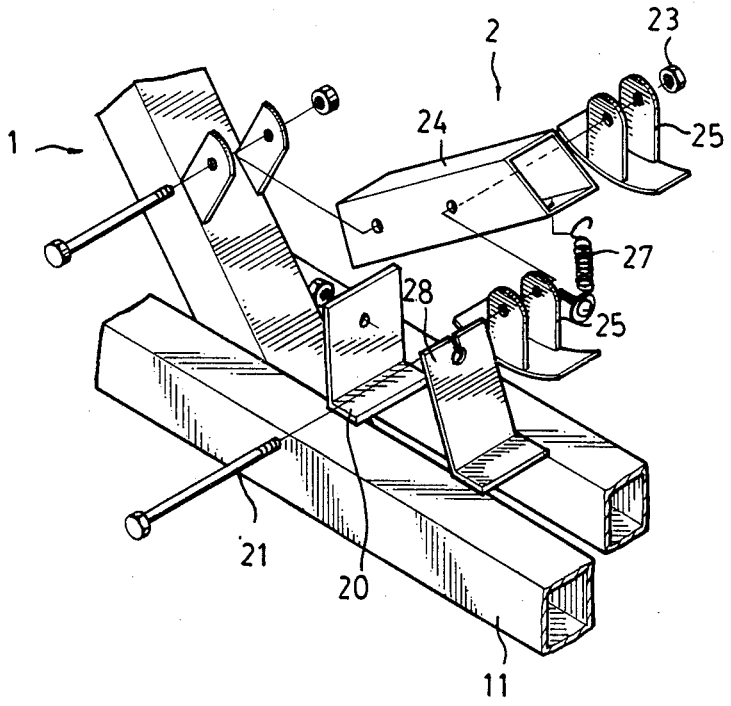
FIG. 3 is a partial perspective view showing a brake unit of the exercise bicycle of FIG. 1.
Figure 4:
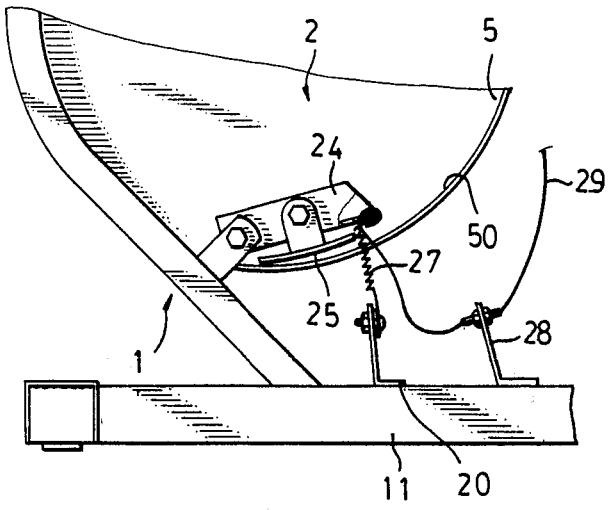
FIG. 4 is a plane view of the brake unit of FIG. 3.

Referring next to FIGS. 3 and 4, the brake unit 2 generally includes a rod 24 with one end substantially pivoted on the frame body 1. A pair of brake shoes 25 are substantially pivoted on a longitudinal intermediate position of the rod 24 by a bolt 21 and nut 23. The shapes of the brake shoes 25 are related to the curve of the rims 20 of the discs 5. A spring element 27 connects with one end to a free end of the rod 24, and the other end to a suitable position of the frame body 1 by means of a bracket 20 coupled to the base 11 so that the spring element 27 always pushes the free end of the rod 24 upward. The cable 29 passes through a guide 28, which is located below the brake unit 2, and connects to the free end of the rod 24 such that the free end of the rod 24 can be pulled downward by the cable 29 against the bias of spring 28 in order to achieve the braking function.

As a whole, the exercise bicycle in accordance with the present invention has a neat and fancy contour. The most complicated part, the chain transmission, is encompassed by the casing 34 and 35. The whole structure of the exercise bicycle is compact. Therefore, the cost is relatively low. The discs 5 provide users with diverse resistances. Discs with different weights are provided for people of different strengths.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercise bicycle comprising generally a frame body with a seat and a pair of handles; a chain transmission being provided on a lower part of said frame body, said chain transmission including two chain wheels and a chain; a pair of foot pedals being pivoted on an axle of a rear chain wheel; a pair of discs being attached to an axle of a front chain wheel and driven by said pedals via said chain transmission; a pair of casings being fixed on both sides of said lower part of said frame body for encompassing said chain transmission; and a brake unit being fixed relative to said frame body at a position substantially between said discs and being actuated by a controller via a cable so as to brake said discs; said controller being provided on one of said handles; said brake unit including a rod with one end relatively pivoted on said frame body, and a free end connected to said cable; a pair of brake shoes being pivoted on both sides of said rod at a longitudinally intermediate position thereof; a lower end of each said brake shoe having a curved shape related to a rim of said disc; a guide being fixed below said brake unit for passing and guiding said cable such that said free end of said rod can be pulled downward by said cable and such that each said brake shoe pressing an inner circular surface of said rim of each said disc; and said frame body having a base with two pairs of extendible shafts for providing a larger base area of said exercise bicycle.

2. An exercise bicycle according to claim 1, wherein one end of a spring element is connected to said free end of said rod, and an other end of said spring element is fixed relative to said frame body 1.

* * * * *